US007043915B2

(12) United States Patent
Anello

(10) Patent No.: US 7,043,915 B2
(45) Date of Patent: May 16, 2006

(54) TURBOCHARGER MOUNTING SYSTEM

(75) Inventor: Anthony M. Anello, Bartlett, IL (US)

(73) Assignee: Internetional Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/852,411

(22) Filed: May 24, 2004

(65) Prior Publication Data

US 2005/0257521 A1 Nov. 24, 2005

(51) Int. Cl.

| | |
|---|---|
| ***F02B 33/44*** | (2006.01) |
| ***F01M 1/00*** | (2006.01) |
| ***F01D 25/26*** | (2006.01) |
| ***F04B 17/00*** | (2006.01) |

(52) U.S. Cl. ..... 60/605.3; 248/678; 248/637; 415/213.1; 417/406

(58) Field of Classification Search ..... 60/605.1, 60/605.3, 612; 417/406, 407; 415/213.1, 415/214.1, 126; 248/678, 637, 639, 646, 248/658, 660, 661, 664, 666, 667

See application file for complete search history.

(56) References Cited

U.S. PATENT DOCUMENTS

| | | | | |
|---|---|---|---|---|
| 1,416,760 | A * | 5/1922 | Steenstrup | 248/678 |
| 3,022,740 | A * | 2/1962 | Wifley et al. | 248/678 |
| 4,414,725 | A * | 11/1983 | Breitweiser et al. | 60/605.1 |
| 4,503,680 | A * | 3/1985 | Wood | 60/605.1 |
| 4,716,735 | A * | 1/1988 | Ruf et al. | 60/605.3 |
| 5,344,286 | A * | 9/1994 | Schafer et al. | 415/213.1 |
| 5,406,795 | A * | 4/1995 | Raub et al. | 60/605.1 |
| 6,305,168 | B1 * | 10/2001 | Furukawa | 60/605.1 |
| 6,688,103 | B1 * | 2/2004 | Pleuss et al. | 60/605.1 |
| 2003/0106982 | A1 * | 6/2003 | Battig et al. | 248/678 |
| 2005/0017151 | A1 * | 1/2005 | Battig | 248/678 |

OTHER PUBLICATIONS

Display Tilt, Swivel, and Swing Mechanism; Jun. 1, 1985; IBM Technical Disclosure Bulletin, Jun. 1985, US; vol. 28; pp. 106-109; TDB-ACC-NO 8506106.*

* cited by examiner

*Primary Examiner*—Thai-Ba Trieu
(74) *Attorney, Agent, or Firm*—Elias P. Scupos; Susan L. Lukasik; Dennis Kelly Sullivan

(57) ABSTRACT

A turbocharger mounting system pivotally mounts a turbocharger on an internal combustion engine. The turbocharger mounting system has a turbocharger unit connected to a mounting mechanism. The turbocharger unit has a first flange and a second flange. The mounting mechanism has multiple clamping devices mounted on a support base. The clamping devices pivotally mount the first and second flanges on the support base. The turbocharger has a fixed connection with the first flange. The fixed connection limits the horizontal movement of the first flange. The turbocharger has a floating connection with the second flange. The floating connection permits the horizontal movement of the second flange.

32 Claims, 17 Drawing Sheets

TURBOCHARGER MOUNTING SYSTEM

FIELD OF THE INVENTION

This invention generally relates to turbochargers used in internal combustion engines. More particularly, this invention relates to turbochargers mechanically mounted on internal combustion engines.

BACKGROUND OF THE INVENTION

Internal combustion engines convert chemical energy from a fuel into mechanical energy. The fuel may be petroleum-based, natural gas, another combustible material, or a combination thereof. Most internal combustion engines inject an air-fuel mixture into one or more cylinders. The fuel ignites to generate rapidly expanding gases that actuate a piston in the cylinder. The fuel may be ignited by compression such as in a diesel engine or through some type of spark such as the spark plug in a gasoline engine. The piston usually is connected to a crankshaft or similar device for converting the reciprocating motion of the piston into rotational motion. The rotational motion from the crankshaft may be used to propel a vehicle, operate a pump or an electrical generator, or perform other work. A vehicle may be a truck, an automobile, a boat, or the like.

Many internal combustion engines have a turbocharger to pressurize or boost the amount of air flowing into the cylinders. The additional air in a cylinder permits the combustion of additional fuel in the cylinder. The combustion of additional fuel increases the power generated by the engine. Generally, an internal combustion engine produces more power with a turbocharger than without a turbocharger.

Most turbochargers have a turbine connected to a compressor. The turbine usually has a turbine wheel positioned to spin inside a turbine housing. The compressor usually has a compressor wheel positioned to spin inside a compressor housing. The turbine wheel usually is connected to the compressor wheel via a common shaft. The turbocharger typically is mounted near the exhaust manifold of the engine. The exhaust gases from the engine pass through the turbine housing. The exhaust gases cause the turbine wheel to spin, thus causing the compressor wheel to spin. The spinning compressor wheel pressurizes the intake air flowing through the compressor housing to the cylinders in the engine.

Turbochargers typically operate in response to the engine operation. Generally, a turbocharger spins faster when the engine produces more exhaust gases and spins slower when the engine produces less exhaust gases. If the turbocharger operates too fast, the turbocharger output may reduce engine performance and may damage the turbocharger and other engine components. If the turbocharger operates too slow, the engine may hesitate, loose power, or otherwise operate inefficiently. The turbocharger efficiency also may be affected by changes in atmospheric pressure, ambient temperature, and engine speed.

Turbochargers may have various configurations to control the output from the turbocharger. Many turbocharger configurations may have a wastegate or a valve to allow exhaust gases to bypass the turbine. Other turbocharger configurations may use a turbine with a variable geometry, where a vane or nozzle inside the turbine housing moves to increase or decrease the exhaust gas flow across the turbine wheel. Some turbocharger configurations may have two compressors connected via a common shaft to the turbine. Yet other turbocharger configurations may have two turbochargers.

Dual turbochargers usually have a first turbocharger and a second turbocharger that are connected to receive exhaust gases and to pressurize the intake air flowing to the cylinders. The first turbocharger usually operates during a one range of intake air pressures. The second turbocharger usually operates during another range of air intake pressures. The first turbocharger may operate during lower intake air pressures. The second turbocharger may operate at higher intake air pressures. The first turbocharger may operate at substantially all intake air pressures, while the second turbocharger may operate at higher intake air pressures. The first and second turbochargers may operate at the same or different times, and may operate together during a transition time when the second turbocharger is activated.

Many turbochargers are mounted on an internal combustion engine by bolts or similar mounting mechanism. The bolts typically pass through holes in a turbocharger base or flange and screw into holes in the internal combustion engine. The connection between the turbocharger base and the internal combustion engine may be mismatched such as when the turbocharger base and engine are uneven, when the holes on the turbocharger base do not align with the holes in the engine, and the like. The turbocharger may be mounted on the engine when the turbocharger base and engine are mismatched. The mismatched connection may create mechanical or installed stresses in the turbocharger and mounting mechanism.

In addition, the hot exhaust gases may cause thermal stresses during operation of the turbocharger. The exhaust gases may raise the temperature of the turbocharger up to about 1500° F. (815° C.) or more. The temperature increase causes thermal expansion of the turbocharger. The temperature decreases when the turbocharger stops operating. The temperature decrease causes thermal contraction of the turbocharger. The thermal expansion and contraction creates thermal stresses within the turbocharger.

These installed and thermal stresses may cause cracking, fatigue, fracture, or other failure of the turbocharger structure. The installed and thermal stresses may increase shear forces or side loads on the mounting bolts or mounting mechanism. The thermal and installed stresses may be more pronounced in dual turbochargers, larger turbochargers such as turbochargers used in diesel engines, and in other turbochargers with a larger or longer connection area with the engine. The size and type of connection area may increase the effect of thermal stresses and may increase the potential for mismatch of the turbocharger with the engine.

Some dual turbochargers have a single-mounting mechanism, where a supporting turbocharger is mounted on the internal combustion engine. The other turbocharger is mounted directly to the supporting turbocharger and not on the internal combustion engine. The supporting and other turbochargers may be difficult or awkward to install as a unit and may increase the engine assembly time if installed separately. The uneven support of a single-mounting mechanism may increase the maintenance of the turbocharger. In addition, the geometry of a single-mounted dual-turbocharger assembly may not be rigid enough to adequately support both turbochargers against engine and turbocharger vibration energy. The noise vibration and harshness may be transmitted to the vehicle and operator.

SUMMARY

This invention provides a turbocharger mounting system that pivotally mounts a turbocharger on an internal combustion engine. The turbocharger has a fixed connection that limits the horizontal movement of the turbocharger. The turbocharger has a floating connection that permits the horizontal movement of the turbocharger.

A turbocharger mounting system may have a turbocharger unit, a support base, and multiple clamping devices. The turbocharger unit has a first flange and a second flange. The support base has a location mechanism connected to the first flange. The location mechanism limits the horizontal movement of the first flange. The clamping devices are mounted on the support base. The clamping devices pivotally mount the first and second flanges to the support base.

A mounting mechanism for a turbocharger in an internal combustion engine may have a support base, multiple clamping devices, and a location mechanism. The support base has one or more pedestals and one or more location platforms. The clamping devices are mounted on the pedestals. The clamping devices are pivotally connected to the support base. The location mechanism is connected to the support base.

In a method for mounting a turbocharger on an internal combustion engine, the turbocharger is pivotally mounted on a support base. The horizontal movement of the turbocharger is limited at a first connection with the support base. The horizontal movement of the turbocharger is permitted at a second connection with the support base.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
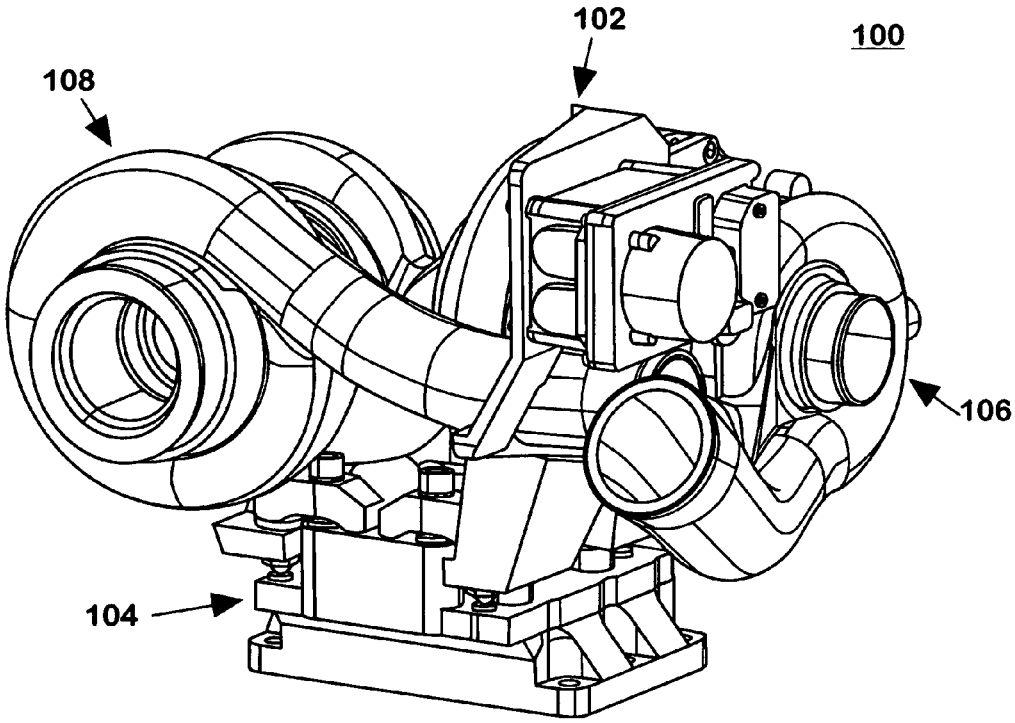
FIG. 1 is a front, perspective view of a turbocharger mounting system.
Figure 2:
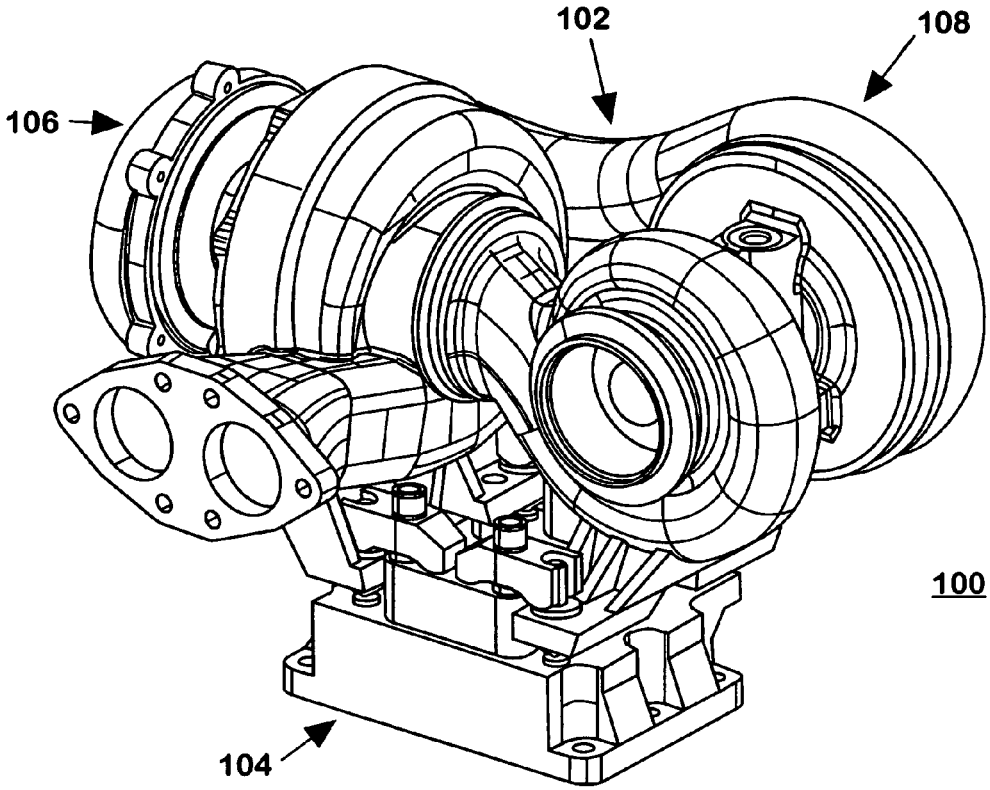
FIG. 2 is a back, perspective view of the turbocharger mounting system of FIG. 1.
Figure 3:
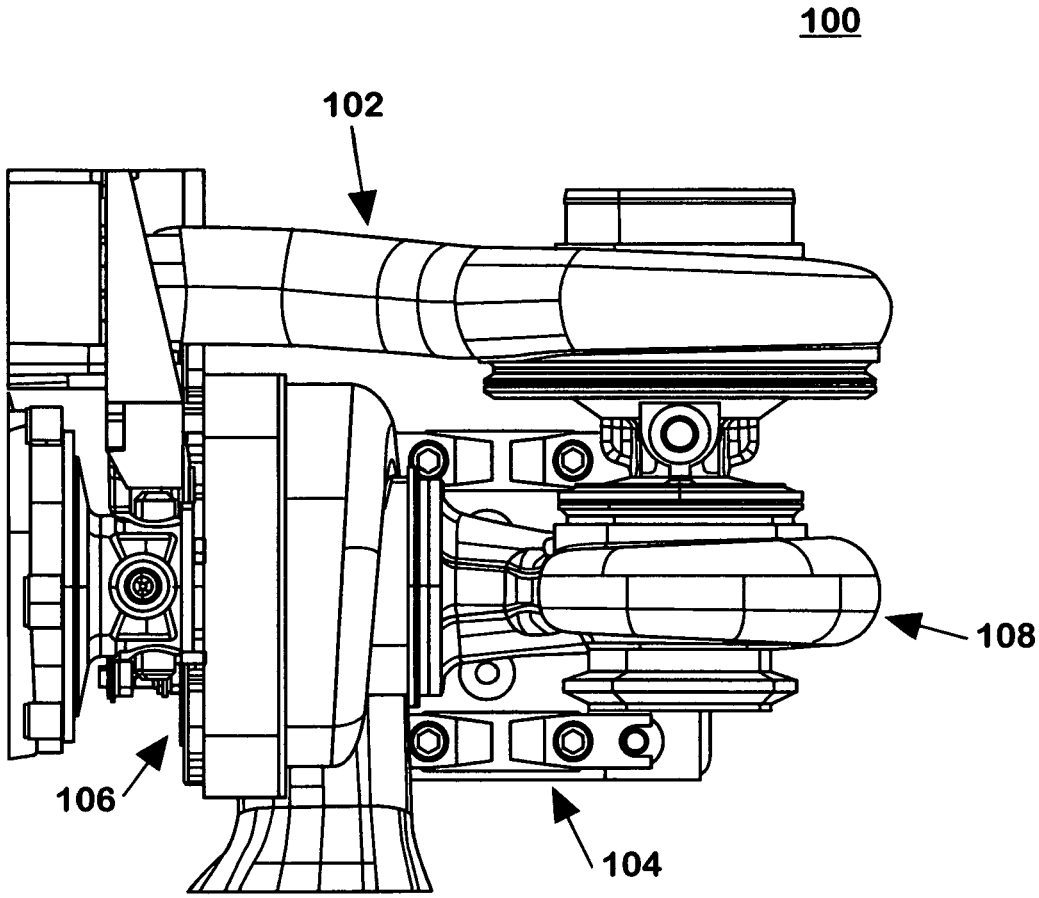
FIG. 3 is a top view of the turbocharger mounting system of FIG. 1.
Figure 4:
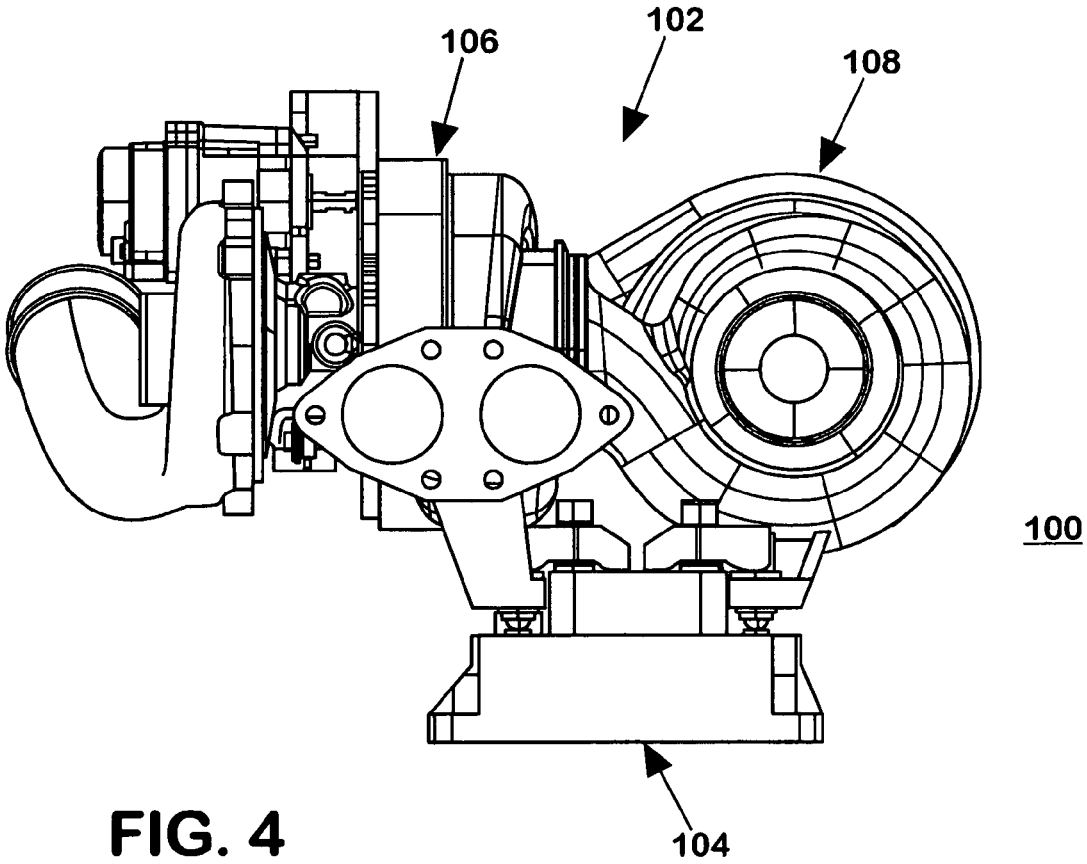
FIG. 4 is a side view of the turbocharger mounting system of FIG. 1.
Figure 5:
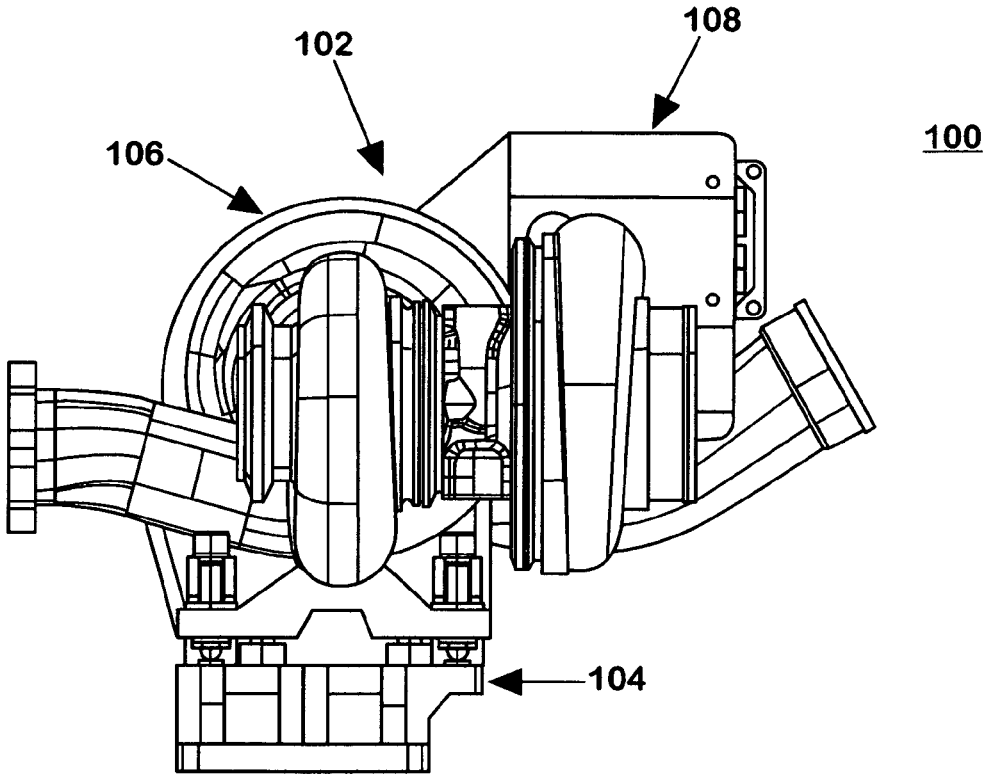
FIG. 5 is a back view of the turbocharger mounting system of FIG. 1.
Figure 6:
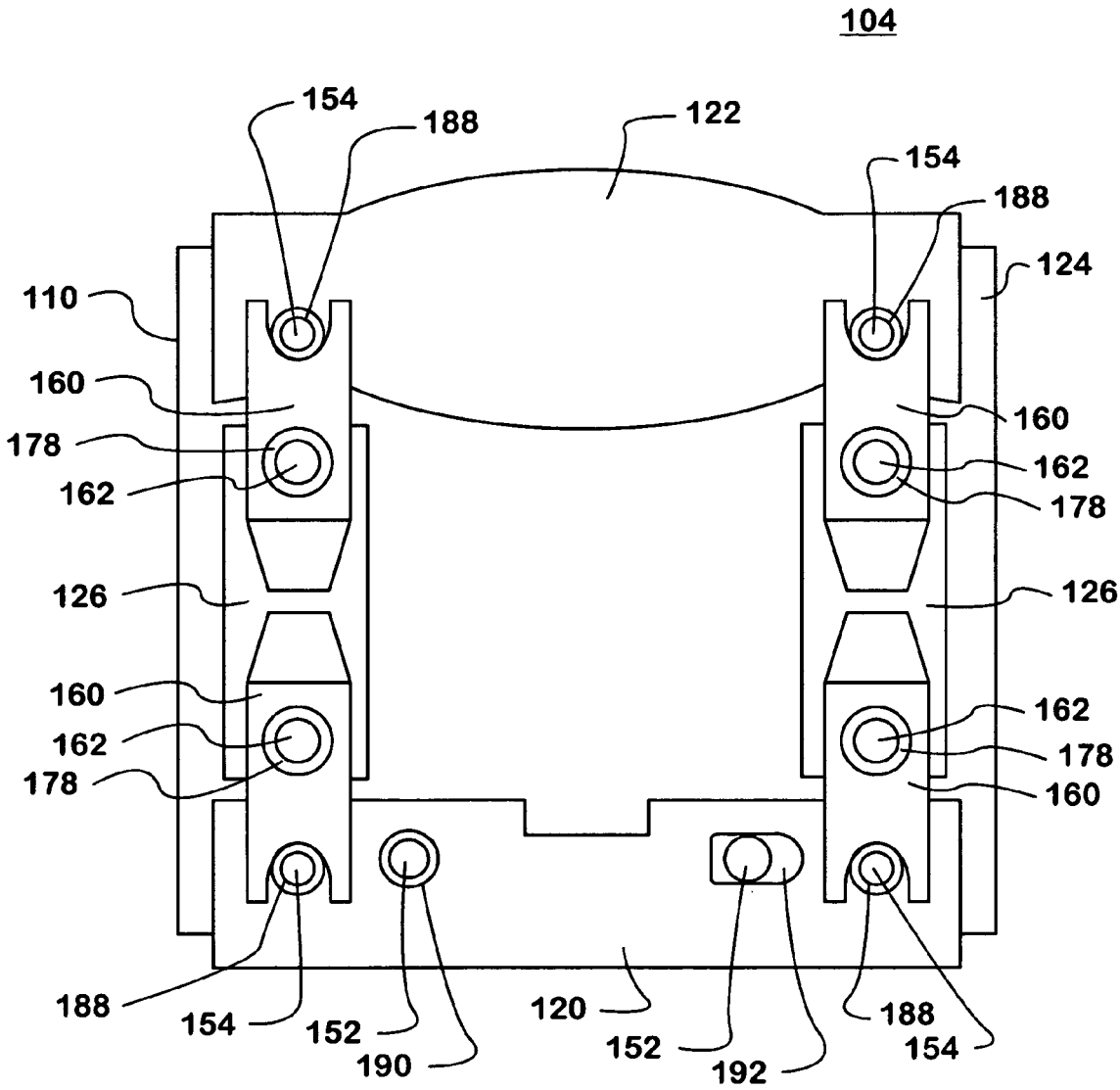
FIG. 6 is a cutaway, top view of a mounting mechanism for the turbocharger mounting mechanism of FIG. 1.
Figure 7:
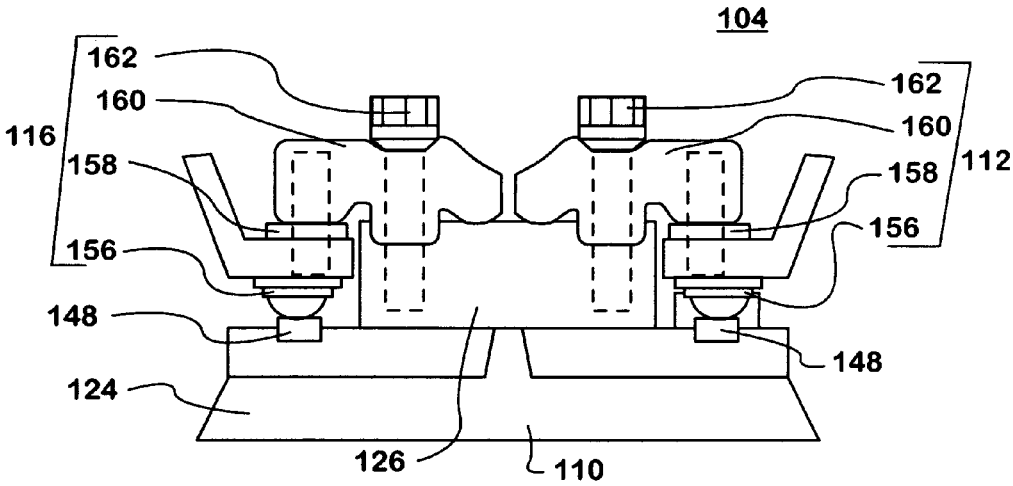
FIG. 7 is a side cross-sectional view of the mounting mechanism of FIG. 6.
Figure 8:
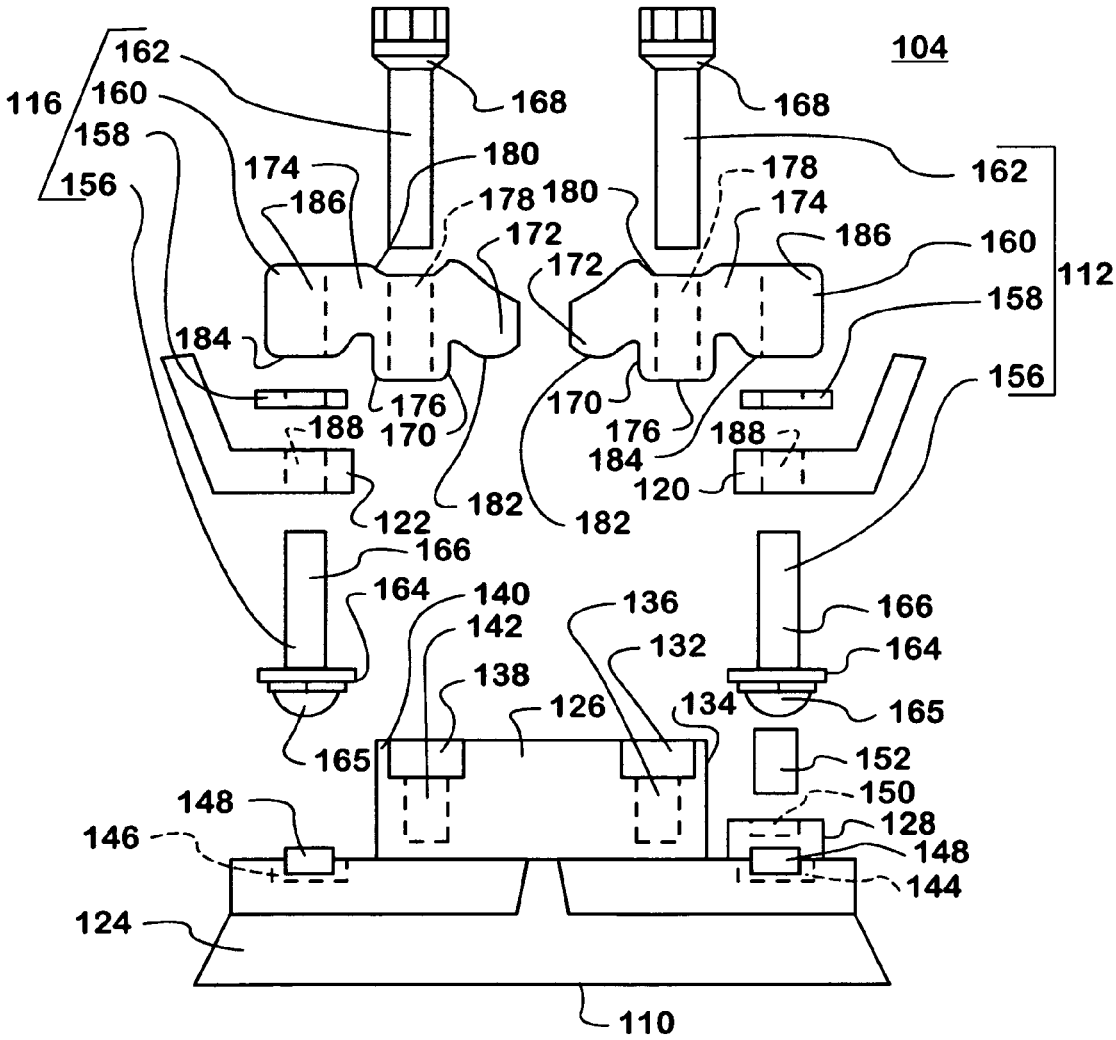
FIG. 8 is an expanded view of the mounting mechanism of FIG. 7.
Figure 9:
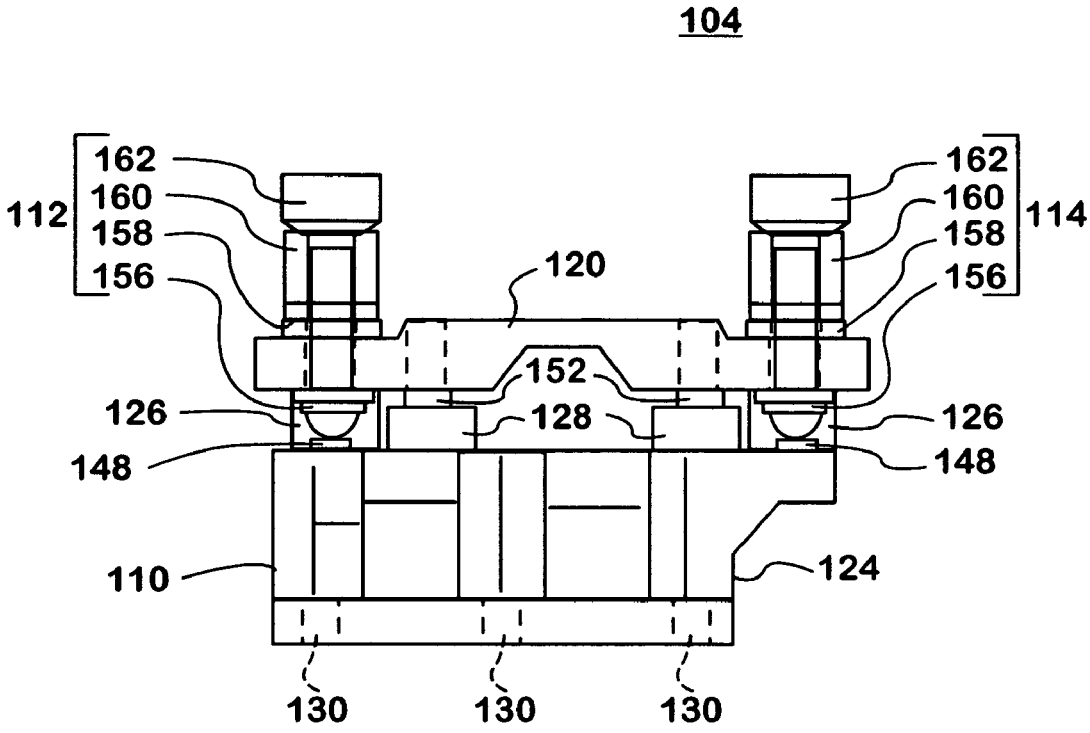
FIG. 9 is a back cross-sectional view of the mounting mechanism of FIG. 6.
Figure 10:
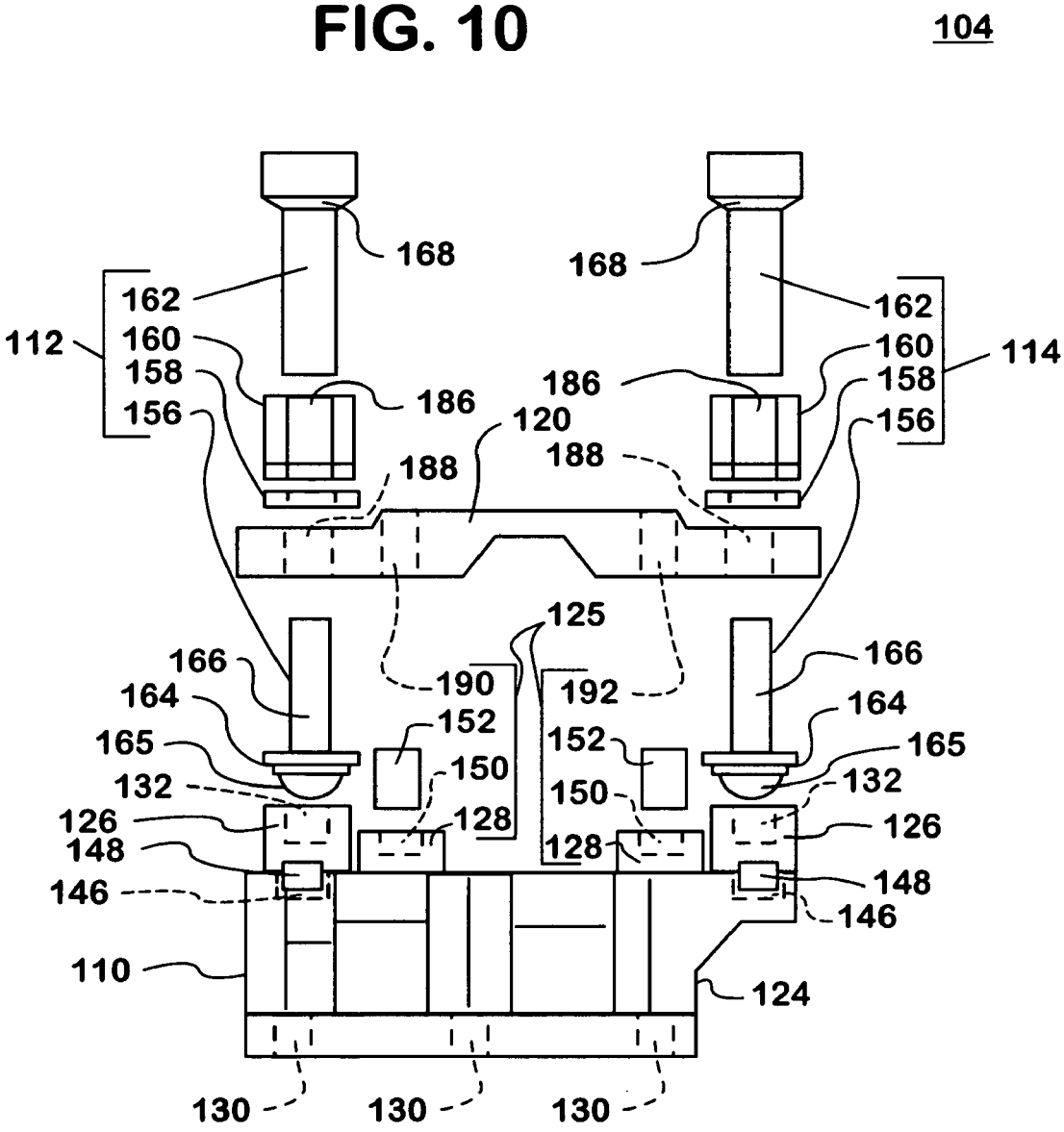
FIG. 10 is an expanded view of the mounting mechanism of FIG. 9.

FIGS. 1–5 show various views of a turbocharger mounting system 100 for an internal combustion engine. The turbocharger mounting system 100 has a turbocharger unit 102 connected to a mounting mechanism 104. The turbocharger unit 102 is a dual turbocharger, having a first turbocharger 106 and a second turbocharger 108. The turbocharger unit 102 may have other configurations such as a single turbocharger, a variable geometry, and the like. The first turbocharger 106 may operate during high intake air pressures. The second turbocharger 108 may operate during low intake air pressures. The turbocharger unit 102 may have other dual turbocharger configurations. The mounting mechanism 104 may be connected to the internal combustion engine by bolts. The mounting mechanism 104 pivotally mounts the first turbocharger 106 and the second turbocharger 108 on the internal combustion engine. The first turbocharger 106 may have a fixed connection that limits horizontal movement at the connection of the first turbocharger 106 with the mounting mechanism 104. The second turbocharger 108 may have a floating connection that permits horizontal movement at the connection of the second turbocharger 108 with the mounting mechanism 104. While a particular configuration is shown, the turbocharger mounting system 100 may have other configurations including those with additional components.

FIGS. 6–10 show various views of the mounting mechanism 104 for the turbocharger mounting mechanism 100. The mounting mechanism 104 has a support base 110 connected to clamping devices 112, 114, 116, and 118. Clamping devices 112 and 114 connect with a first turbocharger flange 120 from the first turbocharger 106. Clamping devices 116 and 118 connect to a second turbocharger flange 122 from the second turbocharger 108. The clamping devices 112, 114, 116, and 118 pivotally mount the turbocharger unit 102 on the support base 110. The mounting mechanism 104 may have a location mechanism 125 connected to the support base 110 and to the first turbocharger flange 120. The location mechanism 125 limits the horizontal movement of the first turbocharger flange 120. The mounting mechanism 104 may have other configurations including those with fewer or additional clamping devices.

The support base 110 has a bottom portion 124 connected to pedestals 126 and location platforms 128. The support base may be made from cast nodular iron or like material. The support base 110 may be integrated with or formed by another engine component such as a cylinder head. The support base 110 may form part of another engine component such as a fuel pump cavity. The support base 110 may be mounted on the internal combustion engine or in the engine compartment of a vehicle. The bottom portion 124 may form holes 130 for mounting the support base 110 onto an internal combustion engine. The pedestals 126 and location platforms 128 are on the same side of the support base 104 and face the turbocharger unit 102. The pedestals 126 and location platforms 128 may have other configurations and may be located at other positions on the bottom portion 124.

The pedestals 126 each have a rectangular configuration and are smaller than the bottom portion 124. The pedestals 126 extend substantially parallel to each other from the front to the back of the support base 104. Each pedestal 126 forms a first pilot opening 132 on a front end 134. The first pilot opening 132 connects to a first cavity 136 formed by each pedestal 126 in the front end 134. The first cavity 136 has a smaller cross-section than the first pilot opening 132. Each pedestal 126 forms a second pilot opening 138 on a back end 140. The second pilot opening 138 connects to a second cavity 142 formed by each pedestal 126 in the back end 140. The second cavity 142 has a smaller cross-section than the second pilot opening 138.

The bottom portion 124 forms bearing surfaces, which may include bearing pins 148 disposed in bearing holes 144 and 146. The bottom portion 124 forms first and second bearing holes 144 and 146 near the front and back ends 134 and 140 of each pedestal 126, respectively. The first and second bearing holes 144 and 146 near one pedestal 126 may be aligned with the first and second pilot openings 132 and 138 in the respective pedestal 126. The other first and second bearing holes 144 and 146 near the other pedestal 126 may be aligned with the first and second pilot openings 132 and 138 in the other pedestal 126. Bearing pins 148 are disposed in bearing holes 144 and 146. The bearing pins 148 may be integrated with or formed by the bottom portion 124. The bearing surfaces may have other configurations.

The location platforms 128 are positioned between the first bearing holes 144 near the front ends 134 of the pedestals 126. Each location platform 128 forms a pin cavity 150. The pin cavities 150 may be aligned with the first bearing holes 144. A location pin 152 is disposed in each pin cavity 150.

The clamping devices 112, 114, 116, and 118, each have a pivot mount 156, a bearing washer 158, a clamp 160 having an opening 154, and a clamp bolt 162. Each pivot mount 156 has a pivot stop 164 connected between a pivot surface 165 and an elongated section 166. The pivot stop 164 may have a cross-section about two times the cross-section of the elongated section 166. The pivot stop 164 may have other cross-sections. The pivot surface 165 may have a spherical or convex configuration. A spherical configuration shape may be hemispheric, another portion of a sphere, or the like. The elongated section 166 may have a cylindrical or other shape. The bearing washer 158 may be made of a graphite alloy or like material. Each clamp bolt 162 may have a spherical flange 168.

Each clamp 160 has a body portion 170 connected between an inside arm 172 and an outside arm 174. The body portion 170 has a pilot section 176 on one side. The body portion 170 forms a mounting bore 178 that extends through the pilot section 176. The body portion 170 may have a flange opening 180 on the side opposite the body portion 170. The flange opening 180 connects to the mounting bore 178. The inside arm 172 has an inside convex surface 182 on the same side of the clamp 160 as the pilot section 176. The outside arm 174 has an outside convex surface 184 on the same side of the clamp 160 as the pilot section 176. The outside arm 174 forms a pivot channel 186 on an outside surface. The pivot channel 186 is essentially parallel to the mounting bore 178 and extends through the outside convex surface 184.

The first turbocharger flange 120 forms pivot bores 188 near opposite ends. The first turbocharger flange 120 forms a location bore 190 and a location slot 192 between the pivot bores 188. The location bore 190 and the location slot 192 may be at other positions on the first turbocharger flange 120. The second turbocharger flange 122 forms pivot bores 188 near opposite ends. The pivot bores 188 may be at other positions on the first and second turbocharger flanges 120 and 122.

The location mechanism 125 includes the location platforms 128, the location pins 152, the location bore 190, and the location slot 192. When assembled, the location pins 152 are disposed in the pin cavities 150 formed by the location platforms 128 and are disposed in the location bore 190 and the location slot 192. The location mechanism 125 limits the horizontal movement of the first turbocharger flange 120. The location mechanism 125 may have other configurations.

To assemble, the clamping devices 112, 114, 116, and 118 are connected to the support base 110 and to the first and second turbocharger flanges 120 and 122. The bearing pins 148 are press-fitted or inserted into the bearing holes 144 and 146 in the bottom portion 124 of the support base 10. The location pins 152 are press-fitted or inserted into the pin cavities 150 in the location platforms 128. The location pins 152 are disposed in the location bore 190 and the location slot 192 of the first turbocharger flange 120. The clamp 160 of each clamping device 112, 114, 116, and 118 is connected to the pedestal 126. The pilot section 176 of the clamp 160 is disposed in the pilot opening 132 or 138 in the pedestal 126. The clamp bolt 162 is inserted through the mounting bore 178, through the pilot opening 132 or 138, and into the cavity 136 or 142 in the pedestal 126. The pivot mount 156 is disposed between the bearing pin 148 and the clamp 160. The pivot surface 165 connects to the bearing pin 148. The elongated section 166 is inserted through the pivot bore 188 in the turbocharger flange 120 or 122, through the bearing washer 158, and into the pivot channel 186 of the clamp 160. The bearing washer 158 is slideably connected to the outside convex surface 184 of the clamp 160.

When assembled, the clamp bolts 162 are tightened to hold the pilot section 176 of the clamp 160 in the pilot opening 132 or 138 of the pedestal 126. The inside convex surface 182 of the clamp 160 presses against the pedestal 126. The outside convex surface 184 presses the bearing washer 158 against the turbocharger flange 120 or 122, which in turn presses against the pivot stop 164 of the pivot mount 156. The pivot stop 164 presses the pivot surface 165 against the bearing pin 148.

The clamping devices 112, 114, 116, and 118 pivotally mount the first and second turbocharger flanges 120 and 122 onto the support base 110. The pivotal mounting may include one or more pivotal connections such as the connections between the pivot mounts 156 and the bearing pins 148, the connections between the inside convex surfaces 182 and the pedestals 126, and the connections between the outside convex surfaces 184 and the bearing washers 158. The pivotal mounting may reduce or eliminate any mismatch between the turbocharger unit 102 and the support base 110.

In each clamping device 112, 114, 116, and 118, the pivot mount 156 may be pivotally connected to the bearing pin 148. When the mounting mechanism 104 is assembled with the turbocharger unit 102, the pivot surface 165 may move bi-axially on the bearing pin 148 to find a position that reduces or eliminates any mismatch between the pivot mount 156 and the bearing pin 148. In different clamping devices, the connection of the pivot mount 156 to the bearing pin 148 may be at different positions on the pivot surface 165 and at different positions on the bearing pin 148.

In each clamping device 112, 114, 116, and 118, the inside convex surface 182 may be pivotally connected to the pedestal 126. When the mounting mechanism 104 is assembled with the turbocharger unit 102, the inside convex surface 182 may rotate on the pedestal 126 to find a position that reduces or eliminates any mismatch between the clamp 160 and the pedestal 126. In different clamping devices, the connection of the clamp 160 to the pedestal 126 may be at different positions on the inside convex surface and at different positions on the pedestal 126.

In each clamping device 112, 114, 116, and 118, the outside convex surface 184 may be pivotally connected to the bearing washer 158. When the mounting mechanism 104 is assembled with the turbocharger unit 102, the outside convex surface 184 may rotate on the bearing washer 158 to find a position that reduces or eliminates any mismatch between the clamp 160 and the bearing washer 158. In different clamping devices, the connection of the clamp 160 to the bearing washer 158 may be at different positions on the outside convex surface 184 and at different positions on the bearing washer 158.

After assembly, one turbocharger 106 or 108 may have a fixed connection with the mounting mechanism 104. The other turbocharger 106 or 108 may have a floating connection with the mounting mechanism 104. The fixed connection may increase the stability of the turbocharger mounting system 100. The fixed connection may maintain the turbocharger unit 102 in substantially the same position during thermal expansion and contraction. The floating connection may reduce or eliminate thermal stresses from the turbocharger mounting system 100.

The first turbocharger 106 may have a fixed connection with the mounting mechanism 104. The fixed connection may limit the horizontal movement of the first turbocharger flange 120 at the connection with the support base 110. The location mechanism 125 may have location pins 152 that are disposed in the pin cavities 150 formed by the bottom portion 124 of the support base 110. The location pins 152 may be disposed in the location bore 190 and the location slot 192. The location pins 152 may limit the horizontal movement of the first turbocharger flange 120. "Limit the horizontal movement" includes a partial or complete reduction of horizontal movement. "Limit the horizontal movement also includes a partial or complete prevention of horizontal movement. Horizontal movement includes movement in a direction that is essentially parallel to the bottom portion 124 of the support base 110. Horizontal movement also includes movement in an essentially radial direction from the location pins 152.

The second turbocharger 108 may have a floating connection with the mounting mechanism 104. The floating connection may permit the horizontal movement of the second turbocharger flange 122 at the connection with the support base 110. During operation, the temperature of the turbocharger unit 102 may increase. After operation, the temperature of the turbocharger unit 102 may decrease. The temperature decrease may cause the thermal contraction of the turbocharger unit 102. In response to the thermal expansion and contraction, the second turbocharger flange 122 may move in a horizontal direction. The bearing washer 158 slides or moves in a horizontal direction along the outside convex surface 184 of the clamp 160. The pivot mount 156 moves in a horizontal direction along the bearing pin 148. The movement of the second turbocharger flange 122 may reduce or eliminate thermal stresses from the thermal expansion and contraction of the turbocharger mounting system 100.

Figure 11:
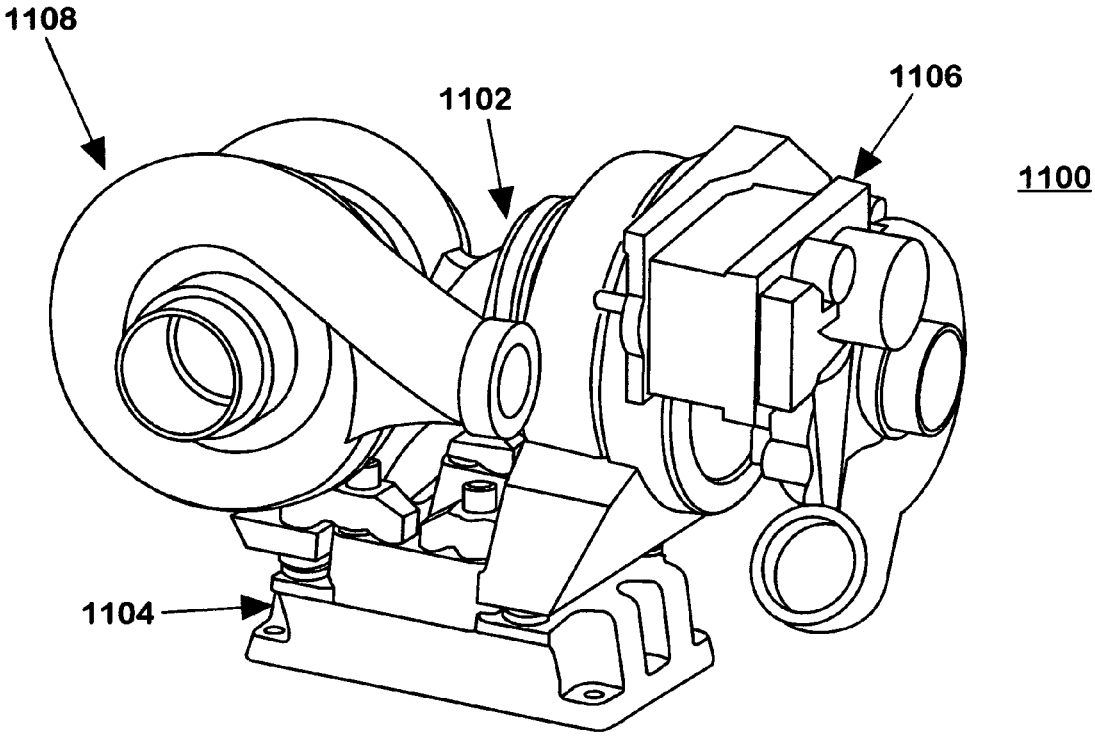
FIG. 11 is a front, perspective view of another turbocharger mounting system.
Figure 12:
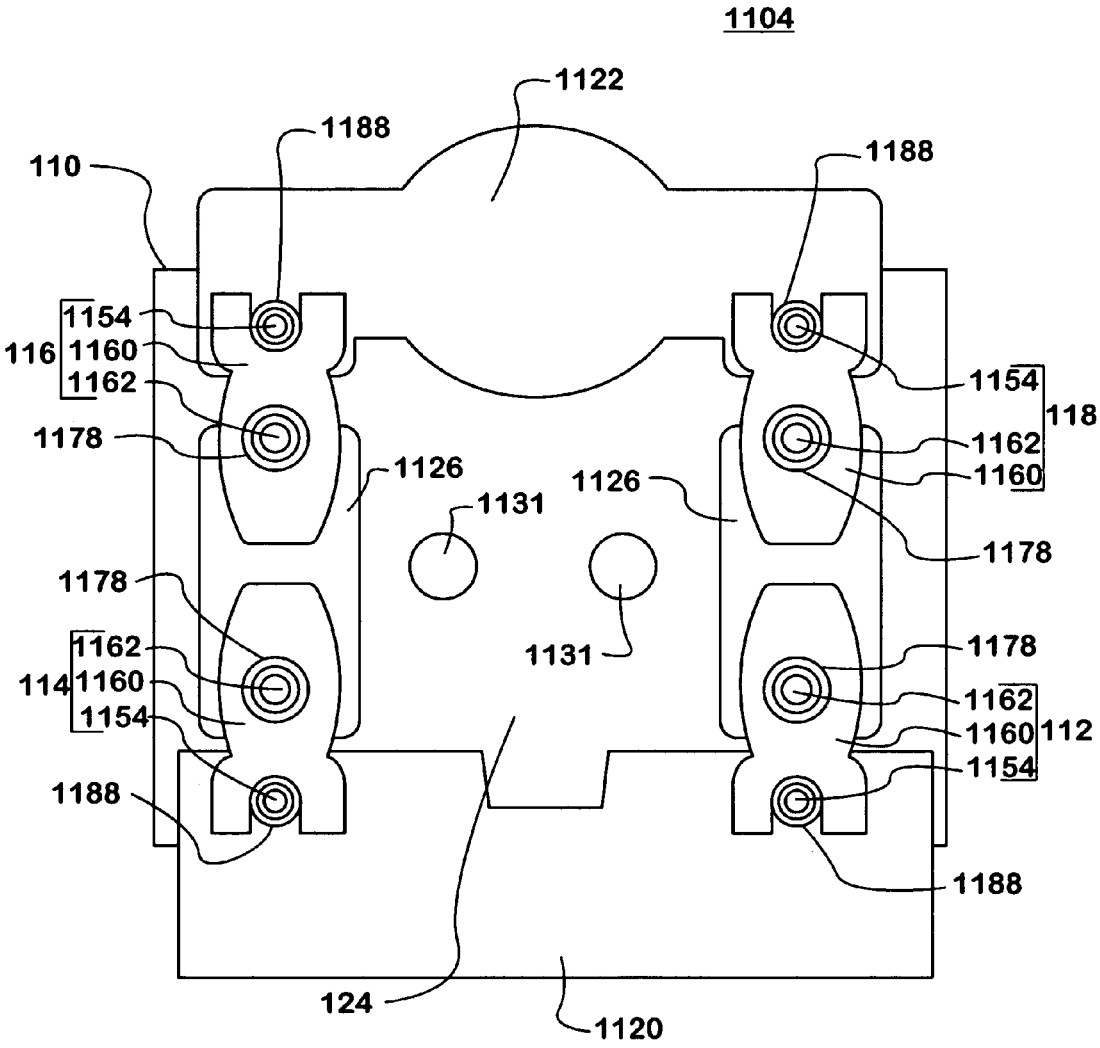
FIG. 12 is a cutaway, top view of a mounting mechanism for the turbocharger mounting mechanism of FIG. 11.
Figure 13:
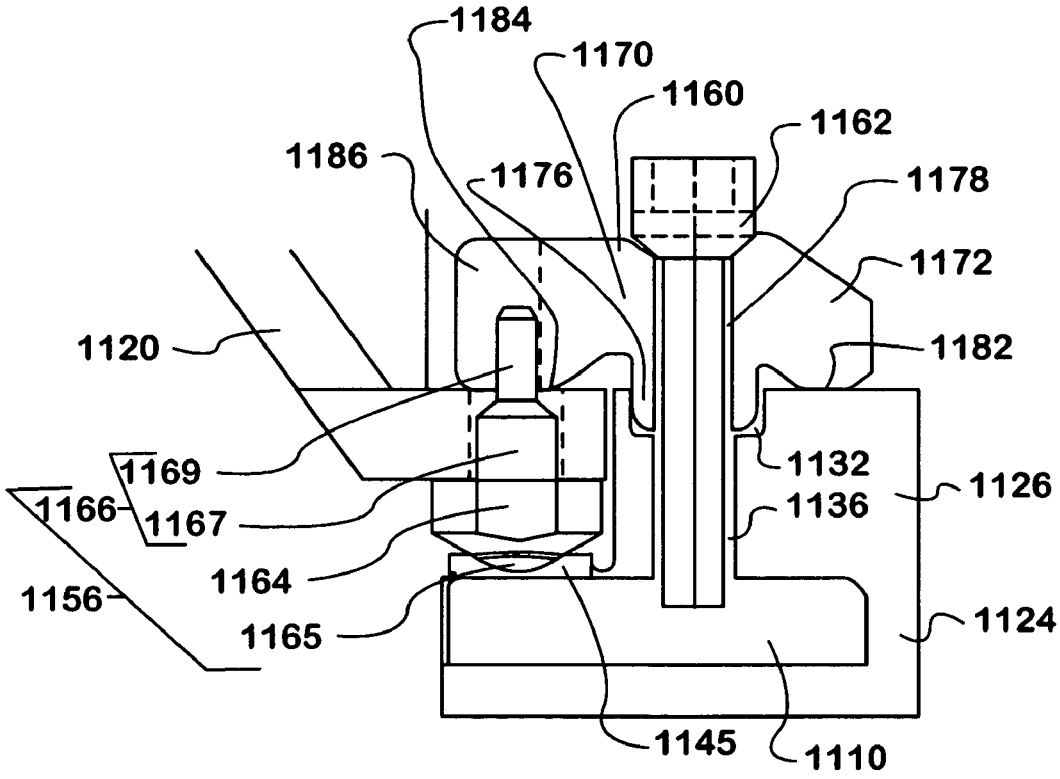
FIG. 13 is a partial cross-sectional view of the mounting mechanism of FIG. 12.
Figure 14:
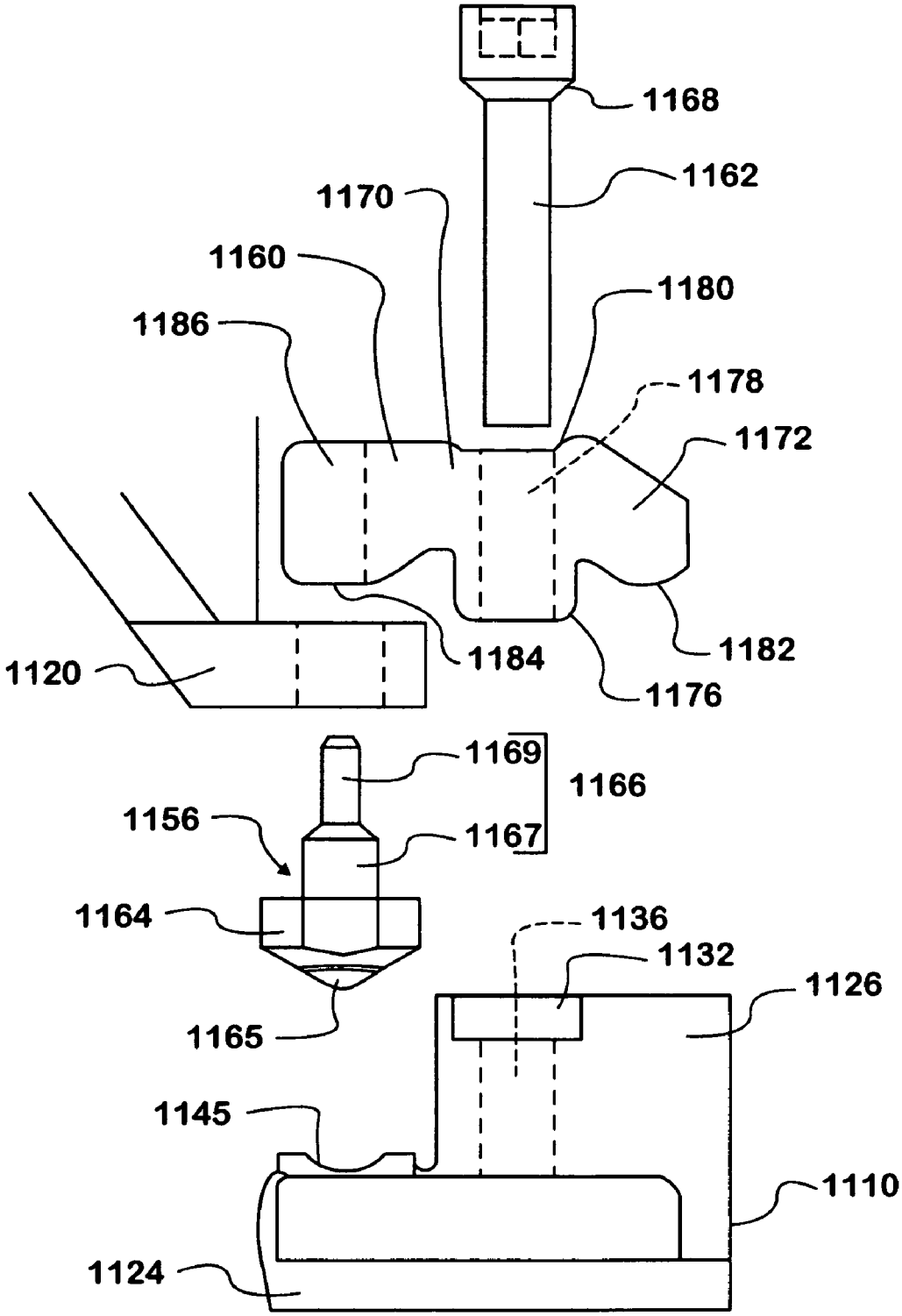
FIG. 14 is an expanded view of the mounting mechanism of FIG. 13.
Figure 15:
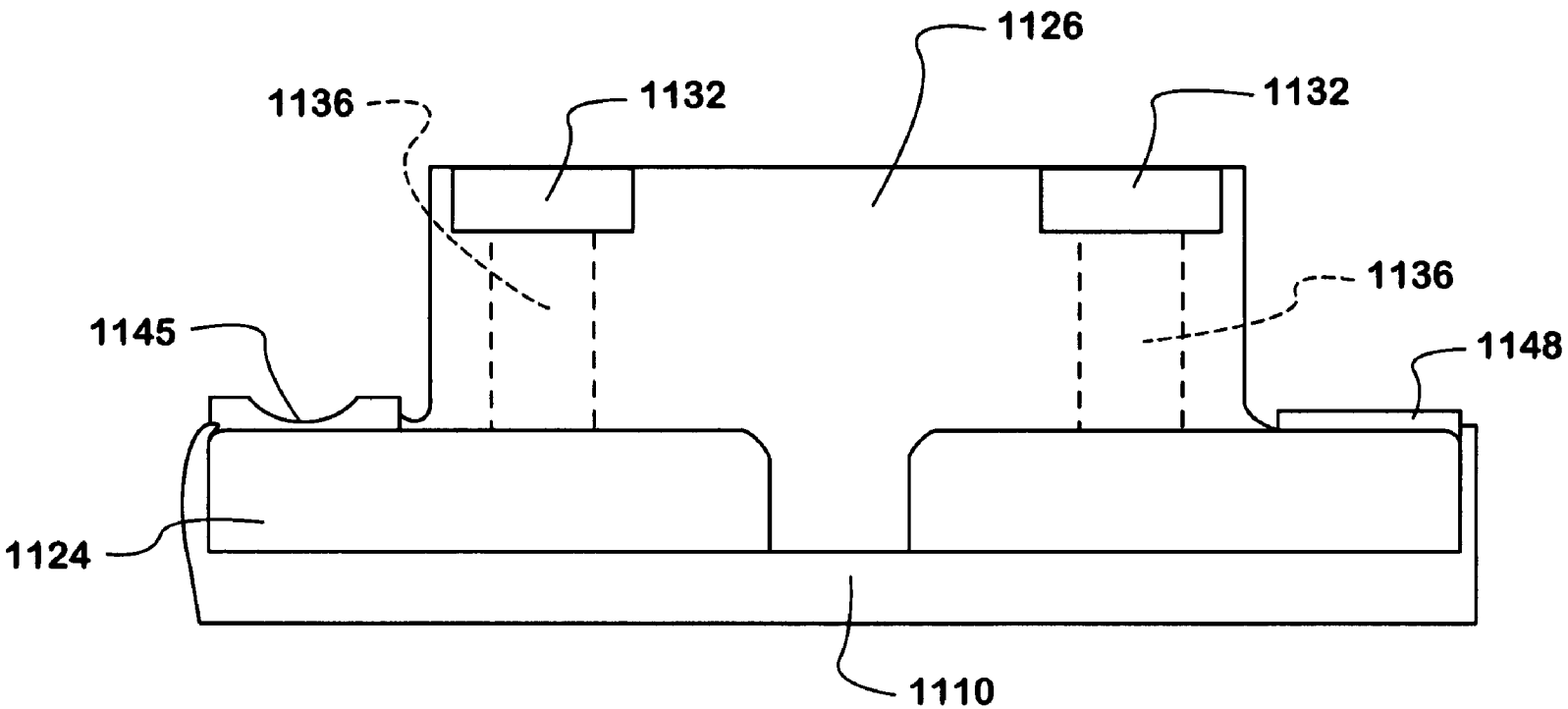
FIG. 15 is a side cross-sectional view of a support base for the mounting mechanism of FIG. 12.
Figure 16:
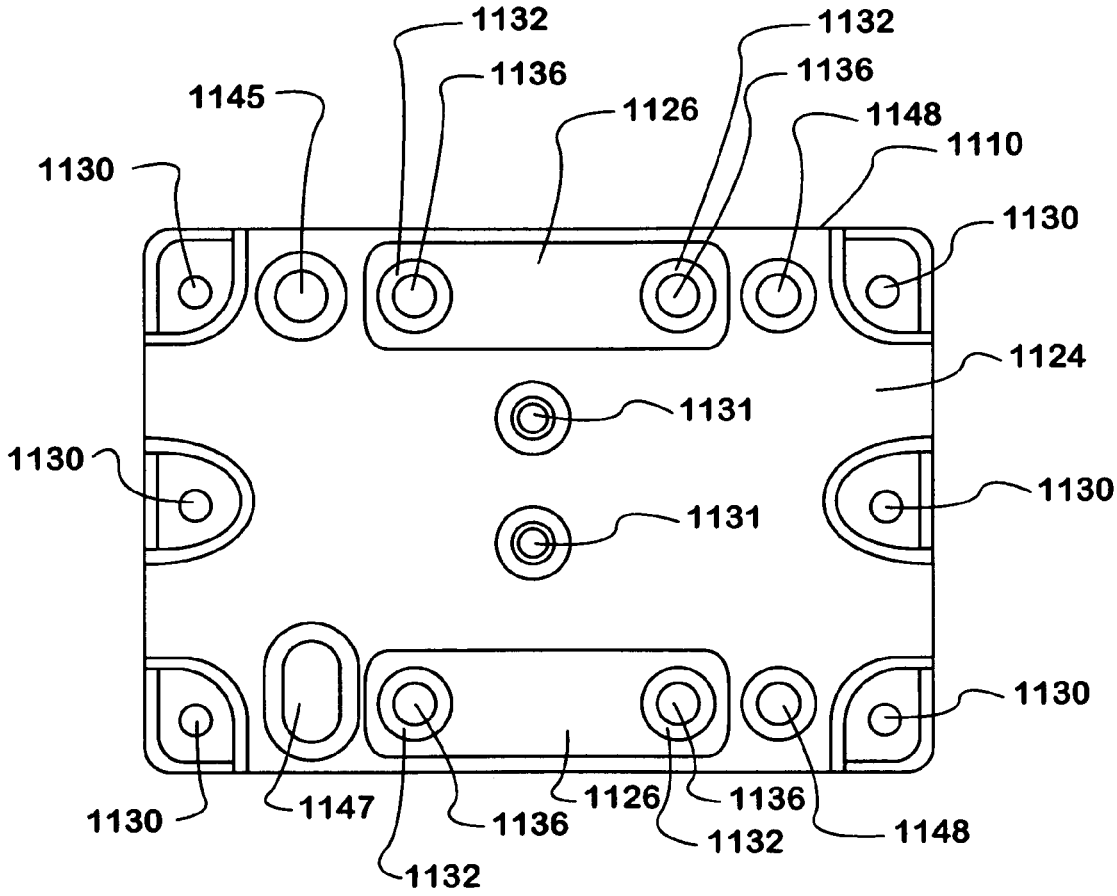
FIG. 16 is a top view of a support base for the mounting mechanism of FIG. 12

FIG. 11 shows a perspective view of another turbocharger mounting system 1100 for an internal combustion engine. The turbocharger mounting system 1100 has a turbocharger unit 1102 connected to a mounting mechanism 1104. The turbocharger unit 1102 is a dual turbocharger, having a first turbocharger 1106 and a second turbocharger 1108. The turbocharger unit 1102 may have other configurations as previously discussed. The mounting mechanism 1104 may be connected to the internal combustion engine by bolts. The mounting mechanism 1104 pivotally mounts the first turbocharger 1106 and the second turbocharger 1108 on the internal combustion engine. The first turbocharger 1106 may have a fixed connection that limits horizontal movement at the connection of the first turbocharger 1106 with the mounting mechanism 1104. The second turbocharger 1108 may have a floating connection that permits horizontal movement at the connection of the second turbocharger 1108 with the mounting mechanism 1104. While a particular configuration is shown, the turbocharger mounting system 1100 may have other configurations including those with additional components.

FIGS. 12–16 show various views of the mounting mechanism 1104 for the turbocharger mounting mechanism 1100. The mounting mechanism 1104 has a support base 1110 connected to clamping devices 112, 114, 116, and 118. Clamping devices 112 and 114 connect with a first turbocharger flange 1120 from the first turbocharger 1106. Clamping devices 116 and 118 connect to a second turbocharger flange 1122 from the second turbocharger 1108. The clamping devices 112, 114, 116, and 118 pivotally mount the turbocharger unit 1102 on the support base 1110. The mounting mechanism 1104 may have other configurations including those with fewer or additional clamping devices.

The support base 1110 has a bottom portion 1124 connected to pedestals 1126. The support base may be made from cast nodular iron or like material. The support base 1110 may form or be formed by another engine component such as a cylinder head, a fuel pump cavity, and the like. The support base 1110 may be mounted on the internal combustion engine or in the engine compartment of a vehicle. The bottom portion 1124 may form edge holes 1130 and center holes 1131 for mounting the support base 1110 onto an internal combustion engine. The pedestals 1126 are on the same side of the support base 1104 and face the turbocharger unit 1102. The pedestals 1126 may have other configurations and may be located at other positions on the bottom portion 1124.

The pedestals 1126 each have a rectangular configuration and are smaller than the bottom portion 1124. The pedestals 1126 extend substantially parallel to each other from the front to the back of the support base 1104. Each pedestal 1126 forms a pilot opening 1132 near each end. Each pilot opening 1132 connects to a cavity 1136 formed by the pedestal 1126. The cavity 1136 has a smaller cross-section than the pilot opening 1132.

The bottom portion 1124 forms bearing surfaces, which include a location well 1145, a slotted well 1147, and slip pads 1148. The bottom portion 1124 forms the location well 1145 near the front end 1134 of one pedestal 1126. The location well 1145 may be concave with an essentially circular circumference. The bottom portion 1124 forms the slotted well 1147 near the front end 1134 of the other pedestal 1126. The slotted well may be concave with an essentially elliptical circumference. The bottom portion 1124 forms slip pads 1148 near the back end 1140 of each pedestal 1126. The location well 1145 and slip pad 1148 near one pedestal 1126 may be aligned with the pilot openings 1132 in the respective pedestal 1126. The slotted well 1147 and slip pad 1148 near the other pedestal 1126 may be aligned with the pilot openings 1132 in the other pedestal 1126. The location well 1145, the slotted well 1147, and slip pads 1148 may be formed on the bottom portion by various metal forming processes such as machining, casting, forging, a combination thereof, and the like. The bearing surfaces may have a burnished or other polished surface. The bearing surfaces may have other configurations.

The clamping devices 112, 114, 116, and 118, each have a pivot mount 1156, a clamp 1160 having an opening 1154, and a clamp bolt 1162. Each pivot mount 1156 has a pivot stop 1164 connected between a pivot surface 1165 and an elongated section 1166. The pivot stop 1164 may have a cross-section about three times the cross-section of the elongated section 1166. The pivot stop 1164 may have other cross-sections. The pivot surface 1165 may have a spherical or convex configuration. The elongated section 1166 may have a middle section 1167 and an end section 1169. The middle section 1167 is between the pivot stop 1164 and the end section 1169. The middle section 1167 and the end section 1169 may have cylindrical configurations. The middle section 1167 may have a larger cross-section than the end section 1169. Each clamp bolt 1162 may have a spherical flange 1168.

Each clamp 1160 has a body portion 1170 connected between an inside arm 1172 and an outside arm 1174. The body portion 1170 has a pilot section 1176 on one side. The body portion 1170 forms a mounting bore 1178 that extends through the pilot section 1176. The body portion 1170 may have a flange opening 1180 on the side opposite the body portion 1170. The flange opening 1180 connects to the mounting bore 1178. The inside arm 1172 has an inside convex surface 1182 on the same side of the clamp 1160 as the pilot section 1176. The outside arm 1174 has an outside convex surface 1184 on the same side of the clamp 1160 as the pilot section 1176. The outside arm 1174 forms a pivot channel 1186 on an outside surface. The pivot channel 1186 is essentially parallel to the mounting bore 1178 and extends through the outside convex surface 1184.

The first turbocharger flange 1120 and second turbocharger flange 1122 each form pivot bores 1188 near opposite ends. The pivot bores 1188 may be at other positions on the first and second turbocharger flanges 1120 and 1122.

To assemble, the clamping devices 112 and 114 are connected to the support base 1110 and to the first turbocharger flange 1120. The clamping devices 116 and 118 are connected to the support base 1110 and to the second turbocharger flange 1122. The clamp 1160 of each clamping device 112, 114, 116, and 118 is connected to the pedestal 1126. The pilot section 1176 of the clamp 1160 is disposed in the pilot opening 1132 in the pedestal 1126. The clamp bolt 1162 is inserted through the mounting bore 1178, through the pilot opening 1132, and into the cavity 1136 in the pedestal 1126.

The pivot mounts 1156 are disposed between the clamps 1160 and the bearing surfaces on the bottom portion 1124. The clamping device 112 has the pivot surface 1165 disposed in the slotted well 1147. The clamping device 114 has the pivot surface 1165 disposed in the location well 1145. The clamping devices 116 and 118 have the pivot surfaces 1165 connect to the slip pads 1148. Each elongated section 1166 is inserted through the pivot bore 1188 in the respective turbocharger flange 1120 or 1122 and into the pivot channel 1186 of the clamp 1160. The middle section 1167 is disposed in the pivot bore in the turbocharger flange 1120 or 1122. The end section 1169 is disposed in the pivot channel 1186 of the clamp 160. The turbocharger flanges 1120 and 1120 are slideably connected to the outside convex surfaces 1184 of the clamps 1160.

When assembled, the clamp bolts 1162 are tightened to hold the pilot section 1176 of the clamp 1160 in the pilot opening 1132 or 1138 of the pedestal 1126. The inside convex surface 1182 of the clamp 1160 presses against the pedestal 1126. The outside convex surface 1184 presses against the turbocharger flange 1120 or 1122, which in turn presses against the pivot stop 1164 of the pivot mount 1156. The pivot stop 1164 presses the pivot surfaces 1165 against one of the bearing surfaces—the location well 1145, the slotted well 1147, or the slip pad 1148.

The clamping devices 112, 114, 116, and 118 pivotally mount the first and second turbocharger flanges 1120 and 1122 onto the support base 1110. The pivotal mounting may include one or more pivotal connections such as the connections between the pivot mounts 1156 and the bottom portion 1124, the connections between the inside convex surfaces 1182 and the pedestals 1126, and the connections between the outside convex surfaces 1184 and the first and second turbocharger flanges 120 and 122. The pivotal mounting may reduce or eliminate any mismatch between the turbocharger unit 1102 and the support base 1110.

In the clamping device 112, the pivot mount 1156 may be pivotally connected to the slotted well 1147. The clamping device 114 may have the pivot mount 1156 pivotally connected to the location well 1145. The clamping devices 116 and 118 may have the pivot mounts 1156 pivotally connected to the slip pads 1148. When the mounting mechanism 1104 is assembled with the turbocharger unit 1102, the pivot surfaces 1165 may move bi-axially on the bearing surfaces to find a position that reduces or eliminates any mismatch between the pivot surfaces 1165 and bearing surfaces. The connections of the pivot mounts 1156 to the bearing surfaces may be at different positions on different pivot mounts 1156 and at different positions on the bearing surfaces.

In each clamping device 112, 114, 116, and 118, the inside convex surface 1182 may be pivotally connected to the pedestal 1126. When the mounting mechanism 1104 is assembled with the turbocharger unit 1102, the inside convex surface 1182 may rotate on the pedestal 1126 to find a position that reduces or eliminates any mismatch between the clamp 1160 and the pedestal 1126. In different clamping devices, the connection of the clamp 1160 to the pedestal 1126 may be at different positions on the inside convex surface and at different positions on the pedestal 1126.

In each clamping device 112, 114, 116, and 118, the outside convex surface 1184 may be pivotally connected to the first turbocharger flange 1120 or the second turbocharger flange 1122. When the mounting mechanism 1104 is assembled with the turbocharger unit 1102, the outside convex surface 1184 may rotate on the first turbocharger flange 1120 or the second turbocharger flange 1122 to find a position that reduces or eliminates any mismatch between the clamp 1160 and the first and second turbocharger flanges 1120 and 1122. In different clamping devices, the connection of the clamp 1160 to the first or second turbocharger flanges 1120 or 1122 may be at different positions on the outside convex surface 1184 and at different positions on the first and second turbocharger flanges 1120 and 1122.

After assembly, one turbocharger 1106 or 1108 may have a fixed connection with the mounting mechanism 1104. The other turbocharger 1106 or 1108 may have a floating connection with the mounting mechanism 1104. The fixed connection may increase the stability of the turbocharger mounting system 1100. The fixed connection may maintain the turbocharger unit 1102 in substantially the same position during thermal expansion and contraction. The floating connection may reduce or eliminate thermal stresses from the turbocharger mounting system 1100.

The first turbocharger 1106 may have a fixed connection with the mounting mechanism 1104. The fixed connection may limit the horizontal movement of the first turbocharger flange 1120 at the connection with the support base 1110. A location mechanism may include the pivot mounts 1156 in the clamping devices 112 and 114 along with the wells 1145 and 1147. The pivot surface 1165 of the pivot mount 1156 in the clamping device 114 is disposed in the location well 1145. The pivot surface 1165 of the pivot mount 1156 in the clamping device 112 is disposed in the slotted well 1147. The location well 1145 and the slotted well 1147 may limit the horizontal movement of the first turbocharger flange 1120. "Limit the horizontal movement" includes a partial or complete reduction of horizontal movement. "Limit the horizontal movement also includes a partial or complete prevention of horizontal movement. Horizontal movement includes movement in a direction that is essentially parallel to the bottom portion 1124 of the support base 1110. Horizontal movement also includes movement in an essentially radial direction from the pivot mounts 1156. The location mechanism 1125 may have other configurations.

The second turbocharger 1108 may have a floating connection with the mounting mechanism 1104. The floating connection may permit the horizontal movement of the second turbocharger flange 1122 at the connection with the support base 1110. During operation, the temperature of the turbocharger unit 1102 may increase. After operation, the temperature of the turbocharger unit 1102 may decrease. The temperature decrease may cause the thermal contraction of the turbocharger unit 1102. In response to the thermal expansion and contraction, the second turbocharger flange 1122 may move in a horizontal direction. The first turbocharger flange 120 may slide or move in a horizontal direction along the outside convex surfaces 1184 of the clamps 1160 in the clamping devices 116 and 118. The pivot mounts 1156 in the clamping devices 116 and 118 may move in a horizontal direction along the slip pads 1148. The movement of the second turbocharger flange 1122 may reduce or eliminate thermal stresses from the thermal expansion and contraction of the turbocharger mounting system 1100.

Figure 17:
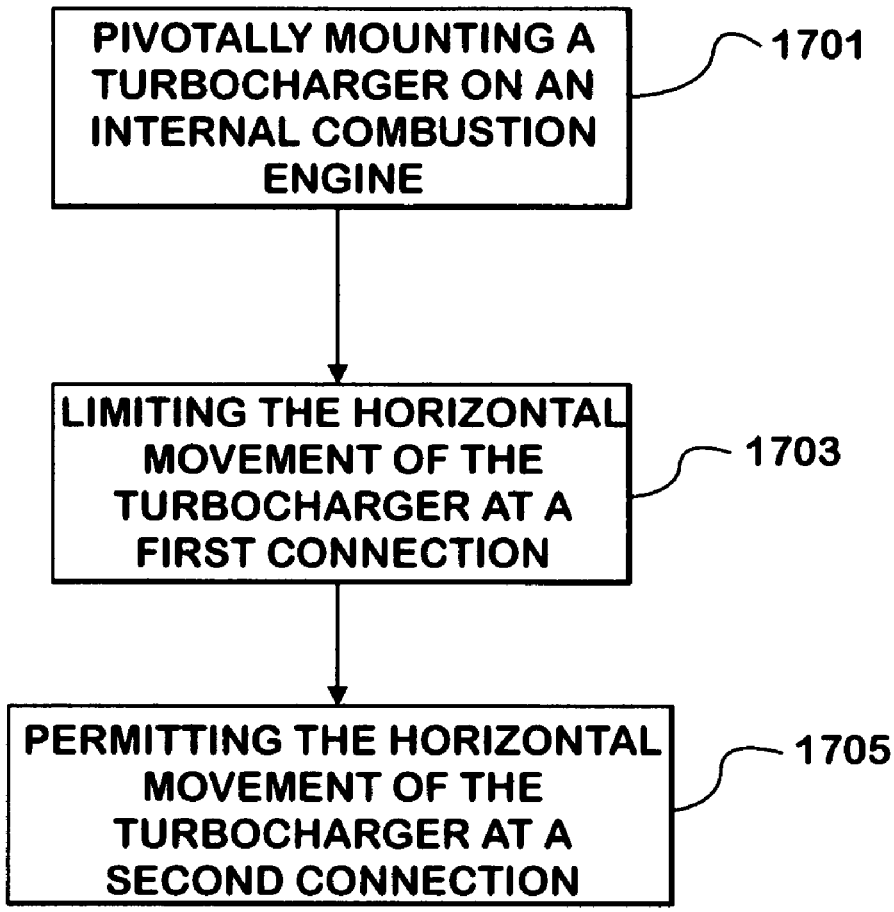
FIG. 17 is a flowchart of a method for mounting a turbocharger on an internal combustion engine.

FIG. 17 is a flowchart of a method for mounting a turbocharger on an internal combustion engine. The turbocharger may be a turbocharger unit or assembly and may have a single turbocharger, a dual turbocharger, a variable geometry turbocharger, or the like. The turbocharger may have other configurations. The turbocharger is pivotally mounted and has fixed and floating connections as previously discussed.

In block 1701, the turbocharger is pivotally mounted on an internal combustion engine. The turbocharger may be pivotally connected by a plurality of clamping devices to a support base, which is mounted on the internal combustion engine. Each clamping device may have a pivot mount that is pivotally connected to a bearing pin on the support base. The pivot mount may move bi-axially on the bearing pin. Each clamping device may have a clamp that is pivotally connected to a pedestal on the support base. The clamp may be pivotally connected to the turbocharger.

In block 1703, the horizontal movement of the turbocharger is limited at a first connection with the support base. A location mechanism may limit the horizontal movement of the turbocharger. The location mechanism may have location pins disposed in the support base and in the turbocharger at the first connection. The location mechanism may have pivot mounts disposed in location and slotted wells at the first connection. The location pins and wells may limit the horizontal movement of the turbocharger at the first location. Other location mechanisms may be used.

In block 1705, the horizontal movement of the turbocharger is permitted at a second connection with the support base. Each clamping device may have a clamp that is slideably connected to the turbocharger by a bearing washer disposed between the clamp and the turbocharger. When the turbocharger thermally expands and contracts, the bearing washer slides or moves along the clamp in a horizontal direction.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A method for mounting a turbocharger on an internal combustion engine, comprising:

pivotally mounting a turbocharger on a support base;

limiting the horizontal movement of the turbocharger at a first connection with the support base; and permitting the horizontal movement of the turbocharger at a second connection with the support base.

2. The method for mounting a turbocharger of claim 1, further comprising pivotally connecting a plurality of clamping devices between the turbocharger and the support base.

3. The method for mounting a turbocharger of claim 2, further comprising pivotally connecting a pivot mount from each clamping device to a bearing surface on the support base.

4. The method for mounting a turbocharger of claim 3, further comprising bi-axially moving the pivot mount on the bearing surface.

5. The method for mounting a turbocharger of claim 1, further comprising pivotally connecting a clamp from each clamping device to a pedestal on the support base.

6. The method for mounting a turbocharger of claim 1, further comprising pivotally connecting a clamp from each clamping device to the turbocharger.

7. The method for mounting a turbocharger of claim 6, further comprising slideably connecting the clamp to the turbocharger.

8. A mounting mechanism for a turbocharger in an internal combustion engine, comprising:

a support base having a bearing surface and at least one pedestal;

a plurality of clamping devices mounted on the at least one pedestal, wherein the plurality of clamping devices has a plurality of pivot mounts pivotally connected to the support base, wherein each pivot mount has a pivot surface connected to the bearing surface, and wherein the pivot surface moves bi-axially on the bearing surface; and a location mechanism connected to the support base.

9. The mounting mechanism of claim 8, where each clamping device includes a clamp and the pivot mount, where the clamp has a body portion connected between an inside arm and an outside arm, where the body portion has a pilot section disposed in a pilot opening formed by the at least one pedestal, where the inside arm has an inside convex surface pivotally connected to the at least one pedestal, where the outside arm has an outside convex surface, where the outside arm forms a pivot channel, where the pivot mount has a pivot stop connected between the pivot surface and an elongated section, where the pivot surface is pivotally connected to the bearing surface on the support base, and where the elongated section is disposed in the pivot channel.

10. The mounting mechanism of claim 9, where the bearing surface is a bearing pin.

11. The mounting mechanism of claim of claim 9, where the bearing surface is one of a location well, a slotted well, and a slip pad.

12. The mounting mechanism of claim of claim 9, where the elongated section has a middle section between an end section and the pivot stop, and where the end section is disposed in the pivot channel.

13. The mounting mechanism of claim 9, where the body portion forms a mounting bore, where the at least one pedestal forms a cavity connected to the pilot opening, and where the clamping device has a clamp bolt disposed in the mounting bore and the cavity.

14. The mounting mechanism of claim 13, where the elongated section is disposed in a bearing washer, and where the bearing washer slideably engages the outside convex surface.

15. The mounting mechanism of claim 14, where the bearing washer comprises a graphite alloy.

16. The mounting mechanism of claim 9, where the pivot surface has a spherical configuration.

17. The mounting mechanism of claim 8, further comprising:

at least one location platform connected to the support base, where the location platform forms at least one pin cavity, and at least one location pin disposed in at least one pin cavity.

18. A turbocharger mounting system, comprising:

a turbocharger unit having a first flange and a second flange;

a support base having a location mechanism connected to the first flange, where the location mechanism limits the horizontal movement of the first flange; and a plurality of clamping devices mounted on the support base, where the plurality of clamping devices pivotally mounts the first and second flanges to the support base.

19. The turbocharger mounting system of claim 18, where the support base has at least one pedestal, where each clamping device has a clamp mounted on the at least one pedestal, where the clamp connects to one of the first and second flanges, and where each clamping device has a pivot mount connected to the support base.

20. The turbocharger mounting system of claim 19, where the clamp has a body portion connected between an inside arm and an outside arm, where the body portion has a pilot section disposed in a pilot opening formed by the at least one pedestal, where the inside arm has an inside convex surface pivotally connected to the at least one pedestal, and where the outside arm has an outside convex surface pivotally connected to one of the first and second flanges.

21. The turbocharger mounting system of claim 20, where the body portion forms a mounting bore, where the at least one pedestal forms a cavity connected to the pilot opening, and where the clamping device has a clamp bolt disposed in the mounting bore and the cavity.

22. The turbocharger mounting system of claim 20, where the clamping device has a bearing washer disposed between the outside convex surface of the clamp and one of the first and second flanges.

23. The turbocharger mounting system of claim 22, where the bearing washer comprises a graphite alloy.

24. The turbocharger mounting system of claim 19, where the pivot mount has a pivot stop connected between a pivot surface and an elongated section, where the pivot surface is pivotally connected to a bearing surface on the support base, where the elongated section is disposed in a flange opening formed by one of the first and second flanges, and where the elongated section is disposed in a pivot channel formed by an outside arm of the clamp.

25. The turbocharger mounting system of claim 24, where the bearing surface is a bearing pin.

26. The turbocharger mounting system of claim 24, where the bearing surface is one of a location well, a slotted well, and a slip pad.

27. The turbocharger mounting system of claim 24, where the elongated section has a middle section between an end section and the pivot stop, where the middle section is disposed in a flange opening formed by one of the first and second flanges, and where the end section is disposed in a pivot channel formed by an outside arm of the clamp.

28. The turbocharger mounting system of claim 24, where the pivot surface has a spherical configuration.

29. The turbocharger mounting system of claim 24, where the pivot surface moves bi-axially on the bearing surface.

30. The turbocharger mounting system of claim 18, where the support base has a first location pin and a second location, where the turbocharger unit comprises a first turbocharger and a second turbocharger, where the first turbocharger has a first flange forming a location bore and a location slot, where the first location pin is disposed in the location bore, where the second location pin is disposed in the location slot, and where the first and second location pins limit the horizontal movement of the first flange.

31. The turbocharger mounting system of claim 18, where the support base has at least one location pin connected to the first flange, where the support base has at least one location platform forming a pin cavity, where the at least one location pin is disposed in the pin cavity, and where the at least one location pin limits the horizontal movement of the first flange.

32. The turbocharger mounting system of claim 18, where the turbocharger unit comprises a dual turbocharger.

* * * * *